US006698123B2

(12) United States Patent
Smith

(10) Patent No.: US 6,698,123 B2
(45) Date of Patent: Mar. 2, 2004

(54) MOUNTING SYSTEM FOR SHEET MATERIAL

(76) Inventor: Marvin A. Smith, 5301 Beethoven St., #101, Los Angeles, CA (US) 90066

( * ) Notice: Subject to any disclaimer, the term of this patent is extended or adjusted under 35 U.S.C. 154(b) by 0 days.

(21) Appl. No.: 09/991,263

(22) Filed: Nov. 15, 2001

(65) Prior Publication Data

US 2003/0089012 A1 May 15, 2003

(51) Int. Cl.[7] ..... G09F 17/00; G09F 21/04

(52) U.S. Cl. ..... 40/603; 40/590; 160/327; 160/385

(58) Field of Search ..... 40/590, 603, 604; 38/102.1, 102.91; 160/328, 329, 378, 269, 327, 385, 386, 389, 404

(56) References Cited

U.S. PATENT DOCUMENTS

| | | | | | |
|---|---|---|---|---|---|
| 3,373,464 | A | | 3/1968 | Ausnit | 24/576 |
| 4,103,445 | A | * | 8/1978 | Smith et al. | 40/603 |
| 4,393,558 | A | * | 7/1983 | Herwegh et al. | 24/459 |
| 4,955,928 | A | | 9/1990 | Tanner | 40/603 |
| 5,042,182 | A | | 8/1991 | King | 40/603 |
| 5,058,299 | A | | 10/1991 | Suzuki | 40/603 |
| 5,245,774 | A | | 9/1993 | Huber | 40/603 |
| 5,301,447 | A | | 4/1994 | Lotter et al. | 40/603 |
| 5,408,784 | A | * | 4/1995 | Wruck et al. | 49/489.1 |
| 5,467,546 | A | | 11/1995 | Kovalak, Jr. | 40/603 |
| 5,664,354 | A | | 9/1997 | Daviau et al. | 40/603 |
| 5,685,099 | A | | 11/1997 | Favata | 40/590 |
| 5,893,227 | A | | 4/1999 | Johansson et al. | 40/603 |
| 6,041,535 | A | | 3/2000 | Holloway et al. | 40/603 |
| 6,073,376 | A | | 6/2000 | Verret | 40/603 |
| 6,088,942 | A | * | 7/2000 | Brooks et al. | 40/603 |
| 6,092,319 | A | * | 7/2000 | Hicks | 40/603 |
| 6,164,364 | A | | 12/2000 | Morris | 160/327 |
| 6,209,245 | B1 | | 4/2001 | Wittenberg | 40/603 |
| 6,241,305 | B1 | | 6/2001 | Troeger et al. | 296/102 |
| 6,250,002 | B1 | | 6/2001 | Wittenberg | 40/603 |
| 6,257,306 | B1 | | 7/2001 | Weldy | 160/327 |
| 6,276,082 | B1 | | 8/2001 | Richards et al. | 40/603 |
| 6,282,822 | B1 | | 9/2001 | Rinzler et al. | 40/590 |
| 6,289,635 | B1 | * | 9/2001 | Procton et al. | 49/467 |
| 6,314,687 | B1 | * | 11/2001 | Schondelmayer et al. | 52/63 |
| 6,324,797 | B1 | | 12/2001 | Fago et al. | 52/222 |
| 6,339,889 | B1 | | 1/2002 | Griesemer et al. | 40/603 |

OTHER PUBLICATIONS

TransMedia Brochure, undated.

* cited by examiner

*Primary Examiner*—Brian K. Green
(74) *Attorney, Agent, or Firm*—Fulbright & Jaworski L.L.P.

(57) ABSTRACT

A mounting for a sheet to the side of a truck or the like includes attachment members forming a rectangle frame. Certain of the attachment members include frame members including mutually parallel multiple engagement surfaces defined on ribs. An elongate retainer, which cooperates with the frame members, is RF welded to the sides of the sheet. The retainer includes an elongate flange with an interlocking surface selectively interlocking with any one of the engagement surfaces on the frame. Both the frame member and the elongate retainer include rails. A tool including pinch rollers squeeze the rails toward one another to tension and mount the sheet. The sheet mounting for a roll-up door further includes rollers extending above the top of the door which are spring mounted. The sheet extends from the lower front of the roll-up door up over the rollers and is attached to the back side of an upper elongate panel of the roll-up door.

16 Claims, 4 Drawing Sheets

MOUNTING SYSTEM FOR SHEET MATERIAL

BACKGROUND OF THE INVENTION

The field of the present invention is apparatus and methods for the mounting of sheet material.

Advertising and other information is often temporarily presented on large sheets which are placed on billboards, truck panels and the like. One form of such sheet material is tensioned vinyl sheet. Such sheet may be printed upon and surrounded by a more rigid plastic border which is RF welded to the sheet. The border typically includes a large bead, circular in cross section, which operates as a tenon in association with a C-shaped mortise associated with a mounting frame.

Mounting frames may take on a plurality of configurations. Of value is the ability to tension the sheet and to maintain it in a tensioned and wrinkle-free state. Mechanisms have been used which first lock the sheet in place and then apply tension through off-center bolts and the like.

A recent system includes a mounting for a sheet that has a bead about its periphery. The system includes frame members forming a rectangle with each frame member having mutually parallel multiple engagement surfaces defined on ribs. As one utility, the frame has been mounted on trucks for advertising. The system further includes elongate retainers having elongate flanges with interlocking surfaces that can selectively interlock with any one of the engagement surfaces on the frame members and retainer mortise elements to receive the tenon beads on the periphery of the sheet. The frame also has frame rails having rail surfaces that face away from corresponding retainer rail surfaces on the rails of the retainers. A tool including pinch rollers squeezes the corresponding rail surfaces toward one another to place the sheet material held by the retainer in tension while the interlocking surface is engaged with the appropriate engagement surface. This system is illustrated in U.S. Pat. No. 6,276,082, the disclosure of which is incorporated herein by reference. To insure that the retainers do not inadvertently separate from the frame during use, a bead of elastic material has been wedged behind the elongate flanges and against the next adjacent ribs.

SUMMARY OF THE INVENTION

The present invention is directed to an elongate retainer for mounting a sheet to an elongate frame member where the frame member includes an engagement surface and a frame rail surface with both of the surfaces facing away from the sheet. The retainer includes an interlocking surface positionable in interlocking engagement with the engagement surface and a retainer rail surface facing away from the frame rail surface, the rail surfaces being oriented such that they might be pinched toward one another for setting the retainer in engagement with the frame member.

In a first separate aspect of the present invention, the elongate retainer further includes a plate extending from the interlocking surface with a portion of the plate having a thin, flexible wall which is attachable to the sheet.

In a second separate aspect, the first separate aspect may further contemplate an elongate retainer formed by coextrusion of two materials with one forming at least a portion of the plate being more flexible than the other. The same portion may have a fusible surface for RF welding to the sheet.

In a third separate aspect of the present invention, a mounting including an elongate attachment, an elongate frame member parallel to and displaced from the elongate attachment and the elongate retainer are contemplated with the retainer having a fusible surface for attachment to the sheet. Again, the elongate retainer may additionally be formed by a coextrusion of two materials with the first demonstrating dimensional stability and the second being more flexible. The second is preferably associated with the portion having the fusible surface for attachment to the sheet. The engagement frame may also include mutually parallel multiple engagement surfaces to accommodate with variations in the mounted sheets. A tool may additionally be employed for the pinching of the rails toward one another to engage the retainer with the frame. This mounting may further be in combination with the sheet and with any panel such as the panel of a truck.

In a fourth separate aspect of the present invention, a mounting process retains one edge of two opposed edges of the sheet at an elongate attachment. The other opposed edge is welded to the elongate retainer. The elongate retainer and the frame rail are then manipulated by pinching the frame rail surface and the retainer rail surface to then move the interlocking surface laterally into engagement with an engagement surface.

In a fifth separate aspect of the present invention, the elongate frame member and the elongate retainer are further held together by a lock which includes a channel positionable over the retainer rail once the elongate retainer and the elongate frame member are interlocked. The channel has a first leg which interlocks with the retainer rail surface and a second leg which is compressed between the elongate flange which is in interlocking engagement with the engagement surface and the next adjacent elongate rib. This compressed second leg may be laterally compressible which may in turn be accomplished through flexible flanges extending laterally and being angled away from the end of that leg.

In a sixth separate aspect of the present invention, a mounting system is contemplated for a roll-up door which has elongate panels hinged together about axes which are parallel to the panels. The mounting includes a roller mount which is spring biased to extend beyond the upper end of the door, a roller rotatably mounted in the roller mount, an elongate attachment and an elongate frame member. The elongate retainer cooperates with the elongate frame member to retain one edge of the sheet. One of the elongate attachment and the elongate frame member is affixed at the inside surface of one of the panels of the roll-up door while the other is affixed at the outside surface of a lower panel. On the top panel, the attachment is outwardly of the roller. As a roll-up door is lifted, the outer vertical surface extends. The placement of the roller provides for an accommodation of that extension by retaining the path length of the sheet between the attachment and the frame member constant.

In a seventh separate aspect of the present invention, any of the foregoing aspects are contemplated to be employed in combination to additional advantage.

Accordingly, it is an object of the present invention to provide an improved mounting system for sheet material. Other and further objects and advantages will appear hereinafter.

DETAILED DESCRIPTION OF THE PREFERRED EMBODIMENT

Figure 1:
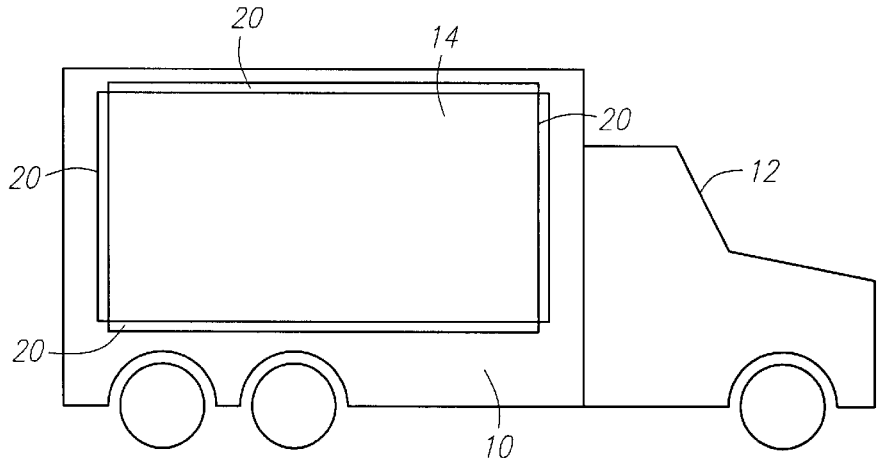
FIG. 1 is the side view of a truck having a mounting and a vinyl sheet mounted thereto.

Turing in detail to the drawings, FIG. 1 illustrates a truck as one possible substrate upon which a mount can be fastened. The mounting system is affixed to the side panel 10 of the truck 12. A sheet 14 is mounted on the panel 10. The sheet 14 is contemplated to be vinyl, which may be printed upon and tensioned when mounted. As employed with the apparatus of FIGS. 6 through 10, the sheet may be mounted toga roll-up door as well. The sheet 14 is finished with a peripheral boundary defined by an elongate retainer as can best be seen in FIG. 2.

In FIG. 1, two sets of members are illustrated to define a rectangular mounting. Both sets include an elongate attachment 20. These attachments 20 may be identical elongate frame members 22 on each side of the sheet 14 or may include a simple clamp or mortise on one side with the elongate frame member 22 and associated hardware disclosed below on the other. The first set is shown to be horizontally disposed with the attachments 20 being mutually parallel and mutually displaced from one another. The second set is vertically disposed and also mutually parallel and displaced from one another. For convenience, the members 20 may all be identical extrusions of elongate frame members 22 but for orientation and length. The frame members 22 are easily mounted to the side panel 10 of the truck 12 by common fasteners, which may be self-tapping screws, bolts and nuts, rivets or the like. As the components are extrusions, the shape of the end views of each of the components reflects the full length of the structure.

Figure 2:
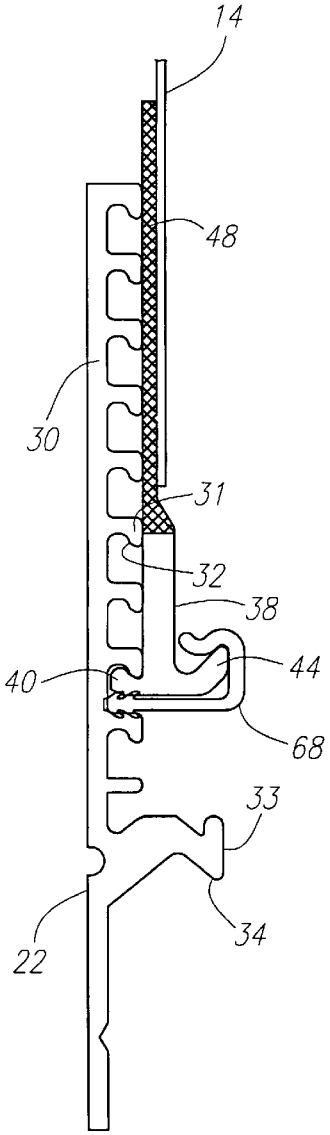
FIG. 2 is an end view of an elongate frame member assembled with an elongate retainer of a mounting, with a sheet.

As best seen in FIG. 2, the elongate frame members 22 include a base plate 30 with parallel elongate ribs 31 extending from one side thereof. The ribs 31 are at a 90° angle to the plane of the base plate 30 but could be equally rigid with other suitable shapes. An engagement surface 32 is located on the side of each rib 31 which is curved but shown to be overall at an acute angle to the base plate 30. The curve of these engagement surfaces 32 is shown to provide an undercut portion to further enhance interlocking. The elongate frame members 22 also include a frame rail 33 having a frame rail surface 34. The frame rail surface 34 faces roughly in the same general direction as the engagement surfaces 32, i.e., away from the sheet 14.

Figure 6:
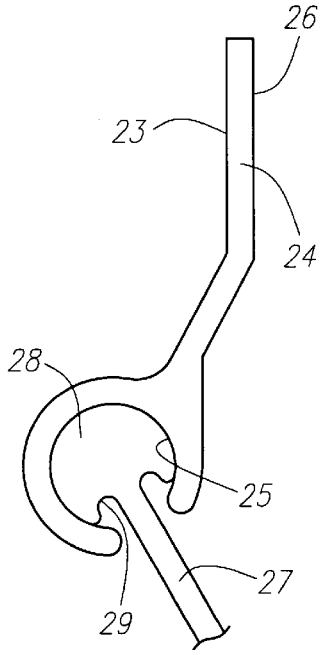
FIG. 6 is an end view of a mortise bracket with a tenon associated with a sheet held therein.

FIG. 6 illustrates a mortise bracket 23 which is employed as the upper attachment 20. The mortise bracket 23 includes an attachment plate 24 for mounting the bracket 23 to the side of a truck 12 and a mortise 25 with an opening. The sheet 14 may be finished along the edge cooperating with the mortise 25 defined by a strip 26 formed with an attachment plate 27 and a bead 28. The bead 28 is roughly circular in cross section with relieved areas 29 to either side of the plate 27 to reduce the concentration of stress during application and use. The bead 28 is preferably offset relative to the attachment plate 27. This offset places the attachment plate 27 on a tangent to the bead 20. The offset draws the sheet closer to the substrate. The bead 28 acts as a tenon in mounting the sheet 14 to the mortise 25. The attachment plate 27 is RF welded or hot air welded to the sheet material. Other bonding techniques may be equally applicable.

The elongate attachments 20 are arranged in sets as noted above. The frame members 22 are each oriented such that the engagement surfaces 32 and the frame rail surface 34 of the elongate frame member 22 face away from the opposed attachment 20 of the same set. The same frame rails surfaces 34 are placed to face outwardly on the vertical elongate frame members 22.

Figure 3:
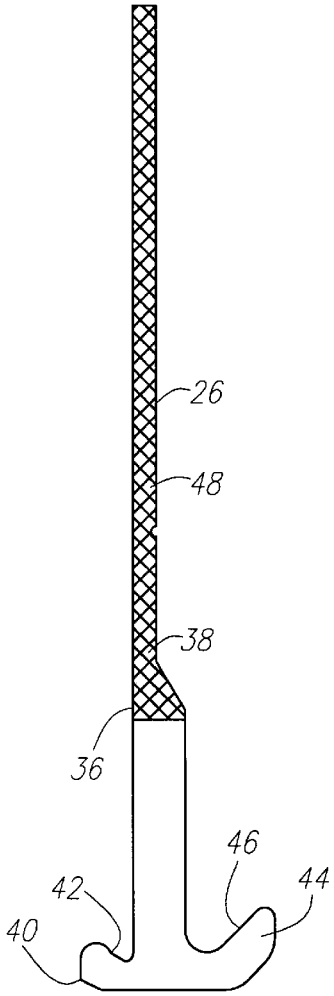
FIG. 3 is an end view of the elongate retainer.

An elongate retainer 36 is illustrated separately in FIG. 3 and in combination with the elongate frame member 22 in FIG. 2. This retainer 36 includes a base plate 38. An elongate flange 40 is located along one edge of the base plate 38 and extends at an angle of approximately 60° from the plane of the base plate 38. The elongate flange 40 includes an interlocking surface 42 on one side of the elongate flange 40. The interlocking surface 42 is within the included angle between the elongate flange 40 and the plane of the base plate 38 and is curved to mate with the engagement surface 32.

The elongate retainer 36 includes a retainer rail 44, which has a retainer rail surface 46 on one side thereof. The retainer rail surface 46 faces away from the frame rail surface 34 when the elongate retainer 36 is assembled with the elongate frame member 22. The base plate 38 is shown to extend in one direction from the elongate flange 40 and the retainer rail 44 with the elongate flange 40 and the retainer rail 44 extending in opposite directions from the plate 38.

In addition to the elongate flange 40 and the retainer rail 44, the elongate retainer 36 includes a portion 48 of the base plate 38 that has a thin, flexible wall that is attachable to the sheet 14. The attachment may be by bonding or mechanical means but is most conveniently to be by RF welding or hot air welding between the sheet 14 and the portion 48 of the plate 38. The portion 48 has at least a surface, and more conveniently the entire body, which is fusible to accommodate the RF welding. The thin, flexible nature of the portion 48 accommodates transition between the overall rigidity of the elongate retainer 36 and the flexible sheet. To further accommodate this transition, the elongate retainer 36 is coextruded of two materials, one more flexible and the other more rigid. The portion 48 of the plate 38 is formed from the flexible material. The elongate flange 40 and the retainer rail 44 are formed of the more rigid and dimensionally stable material. The material of the preferred embodiment is polyvinyl chloride (PVC), with the more flexible material having a density of 1.39 and the more rigid material having a density of 1.46.

FIG. 2 illustrates an association of one of the elongate frame members 22 and one of the elongate retainers 36. The elongate flange 40 is shown extending between the ribs 31 such that the engagement surface 32 and the interlocking surface 42 are positioned in interlocking engagement. This engagement is with the sheet 14 in tension and extending away from the elongate retainer 36 from the portion 48 of the plate 38. Naturally, the elongate flange 40 may be placed in any one of the slots defined between the ribs 31 to assure appropriate tension in the sheet 14.

Figure 5:
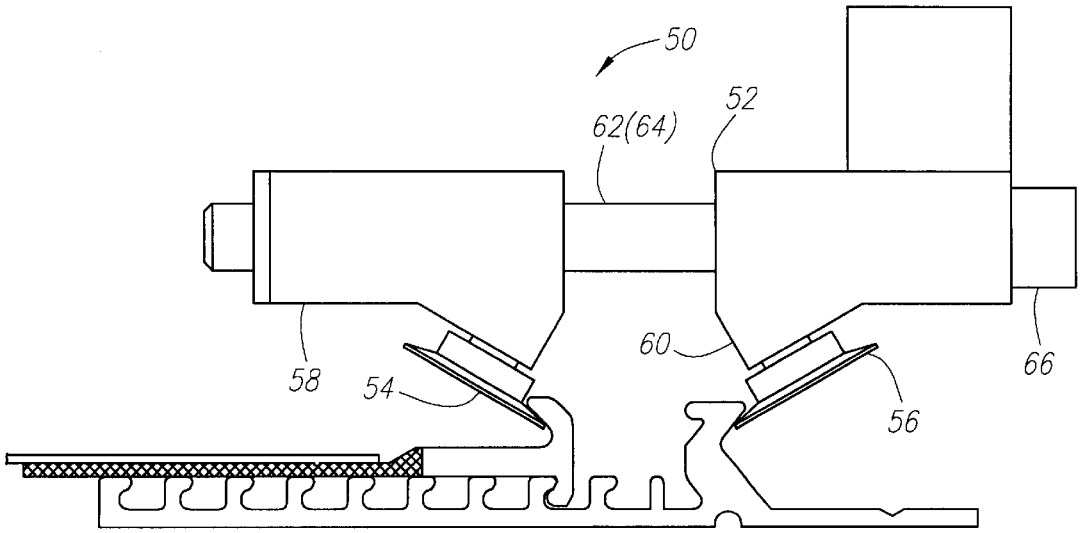
FIG. 5 is an end view of pinch rollers for association with the rails for mounting

From FIG. 2 it can be observed that the elongate frame rail surface 34 on the frame 22 is facing away from the retainer rail surface 46 on the retainer 36. These most adjacent rail surfaces 34 and 46 accommodate a tool. One such tool 50 is illustrated in FIG. 5. The tool 50 includes a frame 52 rotatably supporting two sets of rollers. Each set includes two rollers 54 and 56. The rollers 54 and 56 in each set define a pinch therebetween. The frame 52 mounts the rollers 54 on a first holder 58 and mounts the rollers 56 on a second holder 60. The holders 58 and 60 include parallel guide dowels 62 and 64 and a parallel adjustment screw 66 used to move the rollers 54 and 56 to adjust the pinch. The rollers 54 and 56 are shown to be at an angle to one another. This allows the flanges on the rollers to ride on the rail surfaces 34 and 46.

The two pinch rollers 54 and 56 are mutually displaced at the pinch to accommodate the size of the sheet 14. The frame 52 is adjustable to place the sheet 14 in tension when the tool 50 has the rail surfaces 34 and 46 within the pinch of the rollers 54 and 56. A slight over tension is appropriate to that which will be the final state of the sheet 14 in order that the tool 50 may place the elongate flange 40 in the slots between the ribs 31. As the tool 50 moves forward with the flange 40 progressively located in one of the slots between the ribs 31, the tension from the tool 50 is released and the engagement surface 32 and interlocking surface 42 come into interlocking engagement.

Figure 4:
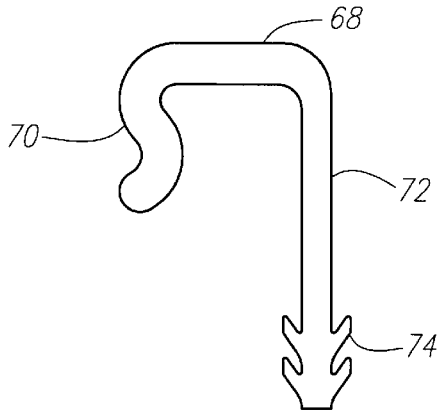
FIG. 4 is an end view of a lock.

FIG. 4 illustrates a lock 68. The lock 68 is illustrated in use in FIG. 2. The lock 68 is defined as a channel which is extruded to have a uniform cross section along its length. The lock 68 is contemplated to be relatively short compared to the full length of the frame with several such locks 68 being put in place about any given frame. The channel includes a first leg 70 which interlocks with the retainer rail surface 46 when in position on the retainer. To accomplish this, the leg 70 is curved to create the engagement as illustrated in FIG. 2. A second leg 72 defining the channel extends to between the elongate flange 40 on the elongate retainer 36 and the next adjacent elongate rib 31. The fit of the second leg 72 in this position is in interference to prevent extraction of the lock 68. The lock 68 is preferably of a dimensionally stable PVC but may exhibit some compression at the end of the second leg 72. The end of the second leg 72 includes flexible flanges 74 which extend laterally and are angled away from the end of the second leg. In this way, the end of the second leg 72 can be laterally compressible.

FIGS. 7 through 10 illustrate a system associated with a roll-up door 76. The roll-up door is conventional in employing elongate panels 78 hinged together about axes parallel to those elongate panels. The panels run in tracks to either side of the door, usually with rollers. A sheet 14 is applied to the outer surface of such a roll-up door 76. The difficulty is that the vertical length of the outer surface of such a door 76 increases while the door is rolled up. This increase is relatively small but results from the panels rotating to a horizontal position. Once one panel has done so, the extended length remains substantially constant. However, the vinyl sheet 14 is unable to accommodate this extension.

The sheet 14 is retained by an elongate attachment to a lower elongate panel 78 of the roll-up door 76. Such an attachment may employ elongate frame members 22. However, at the lower end of the sheet 14, a tenon and mortise attachment as illustrated in FIG. 6 may be employed. The device illustrated in FIGS. 7 through 10 would then be employed at the upper end of the roll-up door 76.

A roller mount 80 is attached to the elongate panel 78 on the back side of the roll-up door 76. The mount 80 is shown to be bolted to the door by fasteners 82. The mount 80 extends in this embodiment most of the way across the span of the elongate panel 78 that will be covered by the sheet 14. An elongate frame member 22 is shown to be affixed to a mounting plate 84. A sheet 14 with an elongate retainer 36 is draped over the top edge of the elongate panel 78 and down to be attached to the elongate frame member 22.

Figure 8:
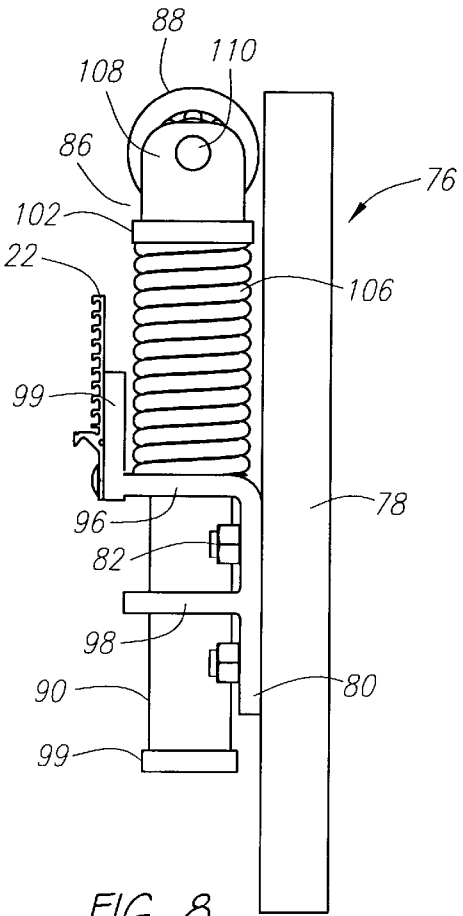
FIG. 8 is the side view of FIG. 6 with the roller retracted.
Figure 7:
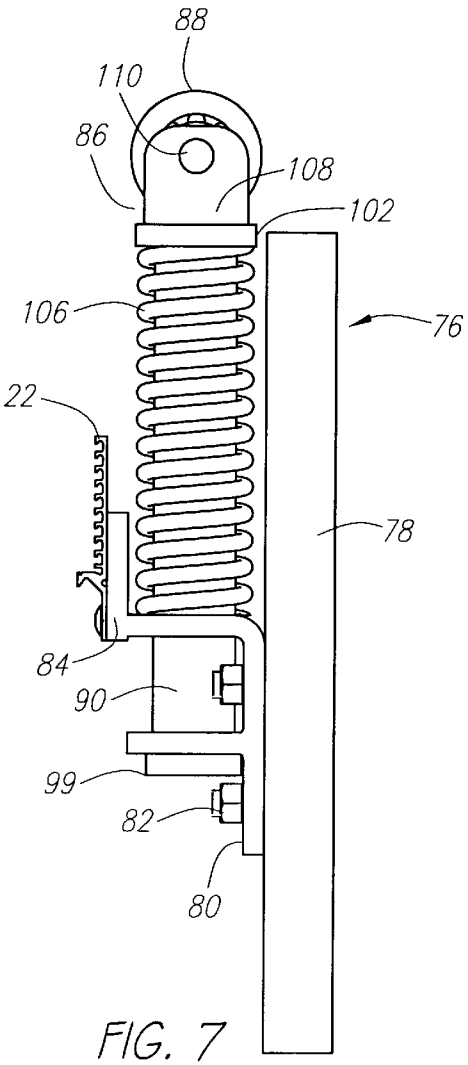
FIG. 7 is a side view of a roller on a roll-up door over which a mounted sheet is to be tensioned.
Figure 9:
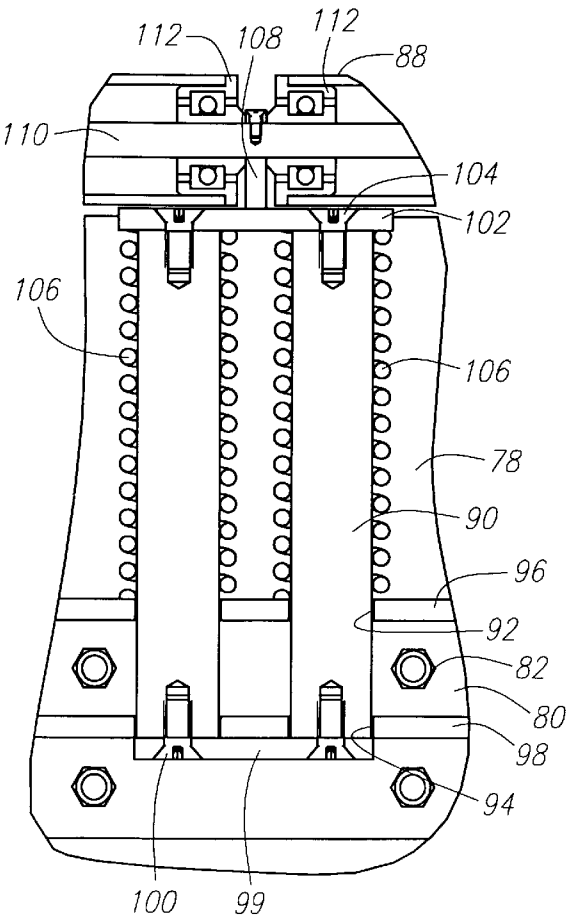
FIG. 9 is a cross-sectional view taken along the center line of the springs of FIG. 6.
Figure 10:
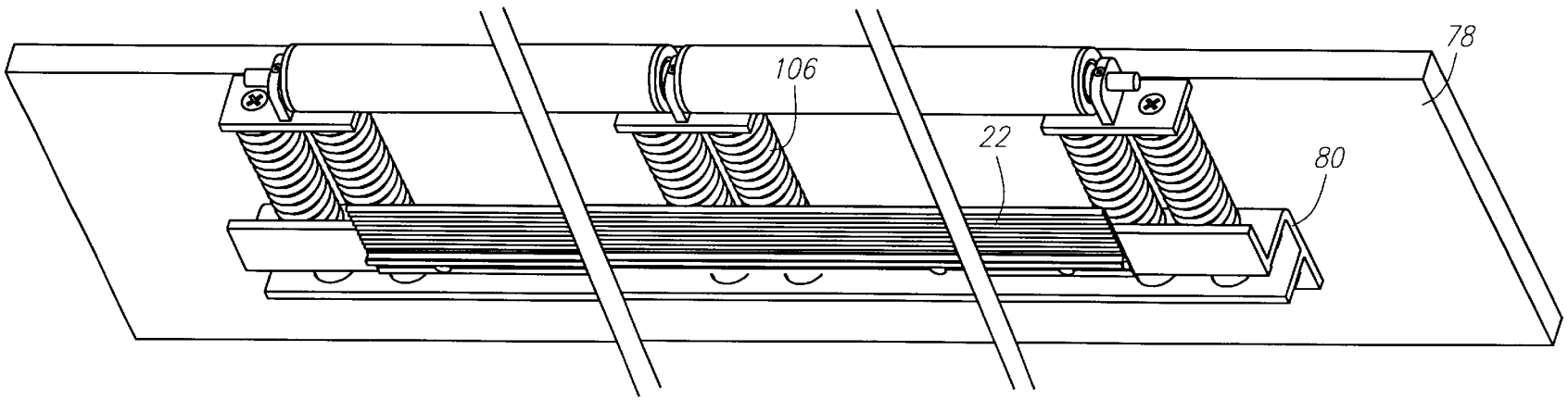
FIG. 10 is a perspective view of a roller assembly on a roll-up door.

To accommodate variation in the outer surface height of the door, roller assemblies adjust the path length of the mounted sheet 14. The roller assemblies include roller mounts 86 slidably mounted relative to the inside surface of the upper panel 78 and rotatably mounting rollers 88 which then are biased to extend beyond the upper end of the door as illustrated in FIG. 7. The roller mounts 86 include cylindrical retainers 90 which extend through holes 92 and 94 in plates 96 and 98, respectively, formed as part of the roller mount 80. These cylindrical retainers 90 are attached in pairs to a bottom plate 99 by fasteners 100. The bottom plate 99 prevents the cylindrical retainers 90 from fully passing through the holes 94. A top plate 102 is similarly arranged on the other end of pairs of cylindrical retainers 90 by fasteners 104. The top plates 102 cooperate with the plates 96 on the roller mount 80 to retain compression springs 106. These springs operate to bias the roller mounts into the extended position as shown in FIG. 7 while FIG. 8 illustrates the springs in compression when the sheet 14 is increased in tension because of the extension of the door while being rolled up or down. A support plate 108 is mounted to each top plate 102 to receive a rod 110. The rod in turn mounts bearings 112 which rotatably support the rollers 88.

In operation, a mortise bracket 23 is preferably mounted to the top of the side 10 of a truck 12 along the attachment plate 24. If a roll-up door 76 is being used, the mortise bracket 23 may more conveniently be mounted to the lower portion of the door. As indicated above, the attachments 20 might be all provided by the elongate frames 22 rather than some by the mortise brackets 23. The bottom of the panel 10 or the top inside surface of a roll-up door 76 is fitted with an elongate frame 22. In the case of the roll-up door, the roller bracket and assembly and are also mounted in place by the fasteners 82. When all four edges of a sheet 14 are to be anchored, an additional set of attachments 20 are mounted vertically.

A sheet 14 is prepared by RF welding strips 26 along the edges of the sheet 14 to be attached. The strips 26 may include beads 28 for receipt by a mortise bracket 23 or for receipt of a retainer as disclosed in U.S. Pat. No. 6,276,082 or may be elongate retainers 36. The first edge of the sheet 14 is placed in a first attachment. This normally would include positioning a bead 28 in a mortise 25 by threading one into the other. The tool 50 is then used to zip the retainer or the elongate retainer 36 in place under tension on an appropriately spaced rib by pinching the rails 33 and 44 and moving the interlocking surface 42 laterally into engagement with the engagement surface 32. Locks 68 are then installed over the retainer rails 44 to complete the installation.

Thus, an improved mounting system is disclosed for large sheet material. While embodiments and applications of this invention have been shown and described, it would be apparent to those skilled in the art that many more modifications are possible without departing from the inventive concepts herein. The invention, therefore is not to be restricted except in the spirit of the appended claims.

What is claimed is:

1. A mounting for a sheet, comprising an elongate attachment;

an elongate frame member parallel and displaced from the elongate attachment, the elongate frame member including an engagement surface facing away from the elongate attachment and a frame rail surface facing away from the elongate attachment;

an elongate retainer including an interlocking surface positionable in interlocking engagement with the engagement surface, a retainer rail surface facing away from the frame rail surface upon engagement of the interlocking surface with the engagement surface and a plate extending from the interlocking surface, a portion of the plate being attachable to the sheet, the plate extending from between the interlocking surface and the retainer rail surface in a first direction, the elongate retainer being formed by coextrusion of two materials, the first material defining the interlocking surface and the retainer rail surface and the second material defining the portion of the plate attachable to the sheet, the second material being less dense and more flexible than the first material.

2. The mounting of claim 1, the first and second materials being polyvinyl chloride.

3. The mounting of claim 1, the elongate frame member further including mutually parallel multiple said engagement surfaces.

4. The mounting of claim 3, the elongate frame member further including parallel elongate ribs extending outwardly from the plate, the mutually parallel multiple engagement surfaces being on the ribs, respectively, and being angled away from the elongate attachment.

5. The combination of claim 1 further comprising a tool including two pinch elements defining a pinch, the pinch being engageable with the frame rail and the retainer rail surfaces.

6. The mounting of claim 5, the pinch elements being rollers.

7. The mounting of claim 1, the portion of the plate having at least a fusible surface for attachment to the sheet.

8. A mounting for a sheet, comprising an elongate attachment;

an elongate frame member parallel and displaced from the elongate attachment, the elongate frame member including an engagement surface facing away from the elongate attachment and a frame rail surface facing away from the elongate attachment;

an elongate retainer including an interlocking surface positionable in interlocking engagement with the engagement surface, a retainer rail surface facing away from the frame rail surface upon engagement of the interlocking surface with the engagement surface and a plate extending from the interlocking surface, a portion of the plate having at least a fusible surface for attachment to the sheet, the plate extending from between the interlocking surface and the retainer rail surface in a first direction, the elongate retainer being formed by coextrusion of two materials, the first material defining the interlocking surface and the retainer rail surface and the second material defining the portion of the plate attachable to the sheet, with the second material being more flexible than the first material.

9. A combination comprising the mounting of claim 8; and a sheet, the portion of the plate being attached to the sheet about at least a portion of the periphery of the sheet.

10. A combination comprising the mounting of claim 9; and a truck, the attachment and the elongate frame member being attached to the truck.

11. A mounting for a sheet, comprising an elongate frame member, the elongate frame member including parallel elongate ribs having mutually parallel engagement surfaces, respectively, facing away from the sheet, and a frame rail surface facing away from the sheet;

an elongate retainer including an elongate flange having an interlocking surface positionable in interlocking engagement with the engagement surfaces, a retainer rail having a retainer rail surface facing away from the frame rail surface upon engagement of the interlocking surface with one of the engagement surfaces and a plate extending from the interlocking surface and being attachable to the sheet;

a lock including a channel positionable over the retainer rail and having a first leg in interlocking engagement with the retainer rail surface and a second leg in interference fit between the elongate flange and an adjacent elongate rib with the channel positioned over the retainer rail.

12. The mounting of claim 11, the second leg being laterally compressible.

13. The mounting of claim 12, the second leg having flexible flanges extending laterally from the second leg and being angled away from the end of the second leg.

14. A mounting system for a sheet having a periphery defining at least two opposed edges and mounted on a roll-up door having elongate panels hinged together about axes parallel to the elongate panels, an upper end, an inside surface and an outside surface, comprising a roller mount slidably mounted relative to the inside surface of the door on an upper one of the panels and spring biased to extend beyond the upper end of the door;

a roller rotatably mounted to the roller mount to extend beyond the upper end of the door;

an elongate attachment for retaining one of the at least two opposed edges; an elongate frame member having at least one engagement surface and a frame rail surface, one of the elongate attachment and the elongate frame member being affixed at a lower one of the panels and the other of the elongate attachment and the elongate frame member being affixed at the inside surface of the upper panel outwardly of the roller;

an elongate retainer having an interlocking surface to engage the at least one engagement surface, a retainer rail surface facing away from the frame rail surface with the interlocking surface engaging the at least one engagement surface and an attachment extending from the interlocking surface attachable to the other of the two opposed edges of the sheet.

15. The mounting system of claim 14 further comprising a bracket affixed to the inside surface of the upper panel, the roller being slidably mounted in the bracket, the other of the elongate attachment and the elongate frame member being mounted to the bracket.

16. The mounting system of claim 15 further comprising a spring mount including a retainer slidably extending through the bracket, the roller being rotatably mounted to the retainer, and a spring between the roller and the bracket about the retainer.

* * * * *